US012044224B2

(12) United States Patent
Park

(10) Patent No.: US 12,044,224 B2
(45) Date of Patent: Jul. 23, 2024

(54) ROTARY COMPRESSOR AND HOME APPLIANCE INCLUDING THE SAME

(71) Applicant: SAMSUNG ELECTRONICS CO., LTD., Suwon-Si Gyeonggi-do (KR)

(72) Inventor: Soodol Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 177 days.

(21) Appl. No.: 17/743,868

(22) Filed: May 13, 2022

(65) Prior Publication Data

US 2023/0019752 A1 Jan. 19, 2023

Related U.S. Application Data

(63) Continuation of application No. PCT/KR2021/018106, filed on Dec. 2, 2021.

(30) Foreign Application Priority Data

Jul. 15, 2021 (KR) ..... 10-2021-0092817

(51) Int. Cl.
*F04B 39/00* (2006.01)
*F04B 39/02* (2006.01)
(Continued)

(52) U.S. Cl.
CPC ..... *F04B 39/0027* (2013.01); *F04B 39/02* (2013.01); *F04B 39/12* (2013.01);
(Continued)

(58) Field of Classification Search
CPC ..... F04C 2240/804
See application file for complete search history.

(56) References Cited

U.S. PATENT DOCUMENTS 6,807,821 B2 * 10/2004 Narney, II ..... F25B 43/006 417/357
8,905,734 B2 12/2014 Shin et al.
(Continued)

FOREIGN PATENT DOCUMENTS

CN 101354042 A 1/2009
CN 203500028 U 3/2014
(Continued)

OTHER PUBLICATIONS

CN209743160machine Translation, CN209743160, Espacenet.com., retrieved on Mar. 5, 2024, 13 Pages. (Year: 2024).*
(Continued)

*Primary Examiner* — Bryan M Lettman
*Assistant Examiner* — Timothy P Solak
(74) *Attorney, Agent, or Firm* — STAAS & HALSEY LLP

(57) ABSTRACT

A rotary compressor includes a compression device including a compression space to accommodate a refrigerant introduced through an inlet, and configured to compress the refrigerant and to discharge the refrigerant to an outlet, a driving device to drive the compression device, a flange member to partition an inner portion of the case into a low-pressure region and a high-pressure region, and a muffler member disposed on a surface of the flange member to form a first space to store oil and a second space. The flange member includes a first hole communicating with the second space to allow the low-pressure region to communicate with the compression space, the muffler member includes a second hole which forms part of a refrigerant flow path, and at least one of the flange member and the muffler member includes a third hole which forms part of an oil flow path.

15 Claims, 11 Drawing Sheets

(51) Int. Cl.

| | |
|---|---|
| ***F04B 39/12*** | (2006.01) |
| *F04B 35/04* | (2006.01) |
| *F04C 23/00* | (2006.01) |
| *F04C 29/06* | (2006.01) |

(52) U.S. Cl.
CPC ..... *F04B 35/04* (2013.01); *F04B 39/121* (2013.01); *F04C 23/008* (2013.01); *F04C 29/065* (2013.01); *F04C 29/068* (2013.01); *F04C 2240/804* (2013.01)

(56) References Cited

U.S. PATENT DOCUMENTS

| | | | | |
|---|---|---|---|---|
| 2004/0165999 | A1 | 8/2004 | Tadano et al. | |
| 2006/0140791 | A1 | 6/2006 | Deming et al. | |
| 2018/0340534 | A1* | 11/2018 | Shin | F04C 18/3442 |

FOREIGN PATENT DOCUMENTS

| | | | | | |
|---|---|---|---|---|---|
| CN | 105604940 | A1 | | 5/2016 | |
| CN | 106870373 | A | | 6/2017 | |
| CN | 106917749 | A | | 7/2017 | |
| CN | 110617222 | A | | 12/2019 | |
| CN | 209743160 | | * | 12/2019 | F04C 18/356 |
| CN | 209743160 | U | | 12/2019 | |
| CN | 112145430 | A | | 12/2020 | |
| JP | 2009-167829 | A | | 7/2009 | |
| JP | 6727300 | | | 7/2020 | |
| KR | 20-1989-0016436 | U | | 8/1989 | |
| KR | 1999-0069774 | | | 9/1999 | |
| KR | 10-2001-0076889 | A | | 8/2001 | |
| KR | 20-0239620 | Y1 | | 9/2001 | |
| KR | 10-0781635 | B1 | | 11/2007 | |
| KR | 10-2015-0088037 | A | | 7/2015 | |
| KR | 10-1801676 | B1 | | 11/2017 | |
| WO | WO-2015120630 | A1 | * | 8/2015 | F04C 23/008 |

OTHER PUBLICATIONS

International Search Report dated Apr. 14, 2022 in InternationalApplication No. PCT/KR2021/018106.
Written Opinion ofthe International Searching Authority dated Apr. 14, 2022 in International Application No. PCT/KR2021/018106.

* cited by examiner

ROTARY COMPRESSOR AND HOME APPLIANCE INCLUDING THE SAME

CROSS-REFERENCE TO RELATED APPLICATION(S)

This application is a bypass continuation of International Application No. PCT/KR2021/018106, filed on Dec. 2, 2021, which is based on and claims priority to Korean Patent Application No. 10-2021-0092817, filed on Jul. 15, 2021, in the Korean Intellectual Property Office, the disclosures of which are incorporated by reference herein in their entireties.

BACKGROUND

1. Field

The disclosure relates to a rotary compressor having a structure enhanced to increase a driving efficiency and having a compact size. The disclosure also relates to a home appliance including the rotary compressor described herein.

2. Description of Related Art

A compressor is a mechanical device for increasing pressure by compressing the air, a refrigerant, or various other working gases by using a motor or a turbine. The compressor may be used across various industries in various ways, and in a case where the compressor is used in a refrigerant cycle, a refrigerant at a low pressure may be converted into a refrigerant at a high pressure and transferred to a condenser again.

The most commonly used compressors may be classified into three types. The compressors may be divided into a reciprocating compressor which forms a compression space for sucking and discharging a working gas between a piston and a cylinder, and allows the piston to linearly reciprocate inside the cylinder to compress a refrigerant, a scroll compressor which forms a compression space for sucking and discharging a working gas between an orbiting scroll and a fixed scroll to allow the orbiting scroll to rotate along the fixed scroll to compress a refrigerant, and a rotary type compressor which forms a compression space for sucking and discharging a working gas between an eccentric rotary rolling piston and a cylinder to allow the rolling piston to eccentrically rotate along an inner wall of the cylinder to compress a refrigerant.

However, the inside of the rotary type compressor of the related art is formed at a high pressure such that the driving efficiency deteriorates, and an accumulator is disposed outside, thereby causing a large space to be taken up.

SUMMARY

Additional aspects will be set forth in part in the description which follows and, in part, will be apparent from the description, or may be learned by practice of the example embodiments. The disclosure is directed to providing a rotary compressor having a structure enhanced to increase a driving efficiency and to have a compact size. The disclosure is also directed to a home appliance including the rotary compressor described herein.

According to example embodiments of the disclosure, there is provided a rotary compressor which may increase a driving efficiency and have a compact size, the rotary compressor including: a case including an inlet and an outlet, a compression device including a compression space to accommodate a refrigerant introduced through the inlet, and to compress the refrigerant in the compression space and discharge the refrigerant to the outlet, a driving device configured to drive the compression device, a flange member configured to partition an inner portion of the case into a low-pressure region which communicates with the inlet and in which the driving device is disposed, and a high-pressure region which communicates with the outlet and in which the compression device is disposed, and a muffler member on a surface of the flange member facing the low-pressure region to form, on an outer side of the muffler member, a first space to store oil, and to form, on an inner side of the muffler member, a second space. The flange member may include a first hole communicating with the second space to allow the low-pressure region to communicate with the compression space, the muffler member may include a second hole which forms a refrigerant flow path from the low-pressure region to the second space, and at least one of the flange member and the muffler member may include a third hole which forms an oil flow path from the first space to the first hole.

The muffler member is curved such that a distance between the surface of the flange member and the muffler member increases from an edge of the muffler member to a center of the muffler member.

The driving device may include a rotating shaft which penetrates through the second hole. The rotating shaft may be connected to the compression device, and the second hole may be formed at the center of the muffler member.

The third hole may be formed in the muffler member to face the first hole.

The third hole may be formed as a plurality of holes along a circumferential direction of the muffler member.

The compression device may include a first cylinder including a first rolling piston which turns with eccentricity in the compression space, and a first vane to come into contact with the first rolling piston to partition the compression space into a first suction chamber and a first compression chamber, a second cylinder including a second rolling piston which turns with eccentricity in the compression space, and a second vane to come into contact with the second rolling piston to partition the compression space into a second suction chamber and a second compression chamber, and a middle plate disposed between the first and second cylinders and including a discharge space to which the compressed refrigerant is discharged from the first and second cylinders and which communicates with the outlet.

The middle plate may include a fourth hole to allow the first suction chamber of the first cylinder to communicate with the second suction chamber of the second cylinder.

The compression device may include a first discharge plate disposed between the first cylinder and the middle plate and including a fifth hole to allow the first suction chamber of the first cylinder to communicate with the fourth hole and a first valve device to allow the first compression chamber of the first cylinder to selectively communicate with the discharge space, and a second discharge plate disposed between the second cylinder and the middle plate and including a sixth hole to allow the second suction chamber of the second cylinder to communicate with the fourth hole and a second valve device to allow the second compression chamber of the second cylinder to selectively communicate with the discharge space.

The case may include a first case in which the inlet is disposed and which forms the low-pressure region, and a second case in which the outlet is disposed and which forms the high-pressure region, the second case having an inner diameter larger than an inner diameter of the first case.

The rotary compressor may further include an inverter, disposed at a part of an outer surface of the case corresponding to the low-pressure region, and configured to supply a driving current to the driving device.

The driving device may include a rotating shaft horizontally disposed and connected to the compression device, and the muffler member may include a center hole disposed below the second hole.

The flange member may include a center region having an inner surface which rotatably supports the rotating shaft and an outer surface which is fit to the center hole.

The rotary compressor may further include an oil supply pipe including one end communicating with an inner portion of the rotating shaft and another end sinking in oil stored in the high-pressure region, and the oil supply pipe may form an oil flow path moving into the rotating shaft from the high-pressure region due to a differential pressure of the high-pressure region and the low-pressure region.

According to one or more aspects of the disclosure, there is provided a home appliance for adjusting a temperature through thermal exchange with outside using a refrigerant, the home appliance including a rotary compressor configured to compress the refrigerant, in which the rotary compressor includes a case including an inlet and an outlet, a compression device including a compression space to accommodate the refrigerant introduced through the inlet, and configured to compress the refrigerant in the compression space and to discharge the refrigerant to the outlet, a driving device configured to drive the compression device, a flange member configured to partition an inner portion of the case into a low-pressure region which communicates with the inlet and in which the driving device is disposed, and a high-pressure region which communicates with the outlet and in which the compression device is disposed, and a muffler member disposed on a surface of the flange member facing the low-pressure region to form, on an outer side of the muffler member, a first space to store oil, and to form, on an inner side of the muffler member, a second space. The flange member may include a first hole communicating with the second space to allow the low-pressure region to communicate with the compression space, the muffler member may include a second hole which forms a refrigerant flow path from the low-pressure region to the second space, and at least one of the flange member and the muffler member may include a third hole which forms an oil flow path from the first space to the first hole.

The home appliance may include any one of an air conditioner, a refrigerator, and a freezer.

BRIEF DESCRIPTION OF DRAWINGS

The above and other aspects, features, and advantages of example embodiments of the disclosure will be more apparent from the following description taken in conjunction with the accompanying drawings, in which.

DETAILED DESCRIPTION

Figure 1:
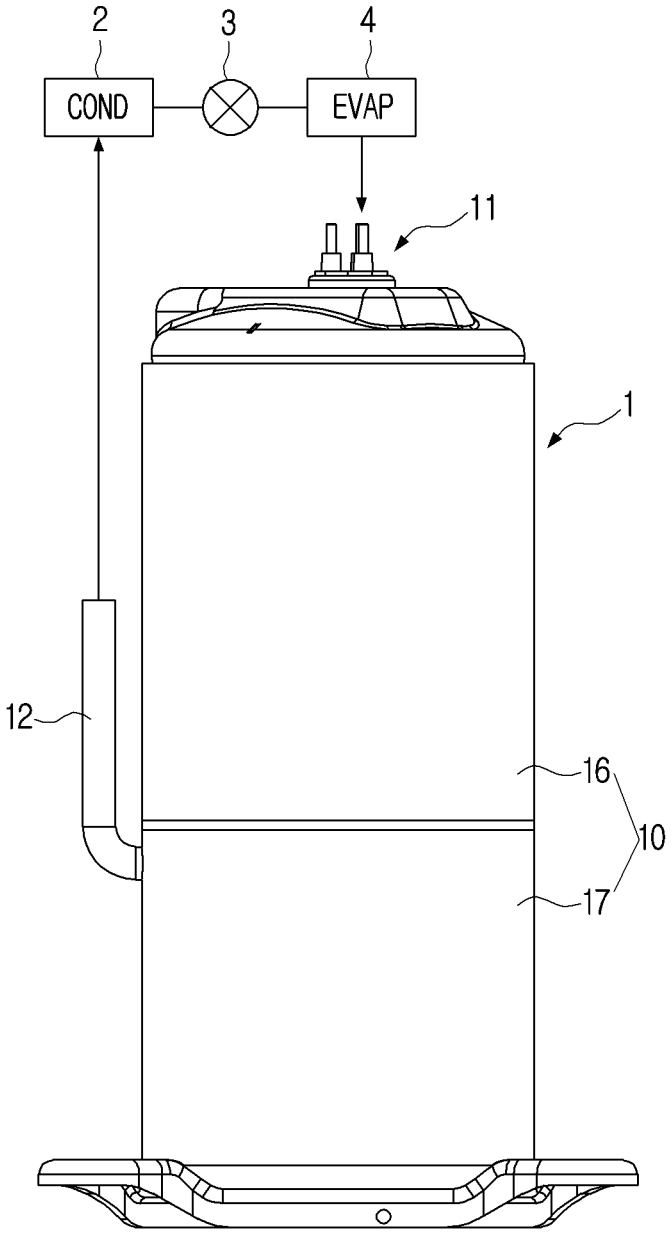
FIG. 1 is a schematic diagram showing a refrigerant cycle provided in a home appliance according to an embodiment.

The examples described below are for understanding of the disclosure and it should be understood that the disclosure may be modified and performed variously unlike in the examples described herein. However, in describing the disclosure, a detailed description of the related art or configuration may be omitted when it is determined that the detailed description may unnecessarily obscure other aspects of the disclosure. In addition, the accompanying drawings may not be illustrated to scale but may be illustrated with enlarged dimensions of some elements, for the understanding of the disclosure.

The terms used in the specification and claims have been selected as general terms as possible in consideration of functions in the disclosure. But, these terms may vary in accordance with the intention of those skilled in the art, the precedent, technical interpretation, the emergence of new technologies and the like. In addition, there may be terms arbitrarily selected by the applicant. Such terms may be interpreted as meanings defined in this specification and may be interpreted based on the general content of the specification and technical knowledge of the technical field, if there are no specific term definitions.

In this disclosure, terms such as "comprise", "including", or "having" and the like are used herein to designate a presence of corresponding features (e.g., constituent elements such as number, function, operation, or part), and not to preclude a presence of additional features. The singular forms "a," "an" and "the" are intended to include the plural forms as well, unless the context clearly indicates otherwise.

Further, in the specification, elements necessary for describing each embodiment of the disclosure are described, and accordingly, there is no limitation thereto. Therefore, some elements may be changed or omitted and other elements may be added. In addition, the elements may be divided and disposed in different independent devices.

It will be understood that, although the terms first, second, third, etc., may be used herein to describe various elements, the elements are not limited by these terms. These terms are only used to distinguish one element from another element. For example, without departing from the scope of the disclosure, a first element may be termed as a second element, and a second element may be termed as a first element.

Descriptions shall be understood as to include any and all combinations of one or more of the associated listed items when the items are described by using the conjunctive term "and/or," or the like. That is, the term "and/or" includes a plurality of combinations of relevant items or any one item among a plurality of relevant items. Thus, the scope of the expression or phrase "A and/or B" includes all of the following: (1) the item "A", (2) the item "B", and (3) the combination of items "A and B".

In addition, the scope of the expression or phrase "at least one of A and B" is intended to include all of the following:

(1) at least one of A, (2) at least one of B, and (3) at least one A and at least one of B. Likewise, the scope of the expression or phrase "at least one of A, B, and C" is intended to include all of the following: (1) at least one of A, (2) at least one of B, (3) at least one of C, (4) at least one of A and at least one of B, (5) at least one of A and at least one of C, (6) at least one of B and at least one of C, and (7) at least one of A, at least one of B, and at least one of C.

When it is stated in the disclosure that one element is "connected to" or "coupled to" another element, the expression encompasses an example of a direct connection or direct coupling, as well as a connection or coupling with another element interposed therebetween.

The embodiments of the disclosure will be described in detail with reference to the accompanying drawings and description in the accompanying drawings, but the disclosure is not limited by the embodiments.

Hereinafter, the disclosure will be described in more detail with reference to the accompanying drawings.

Figure 2:
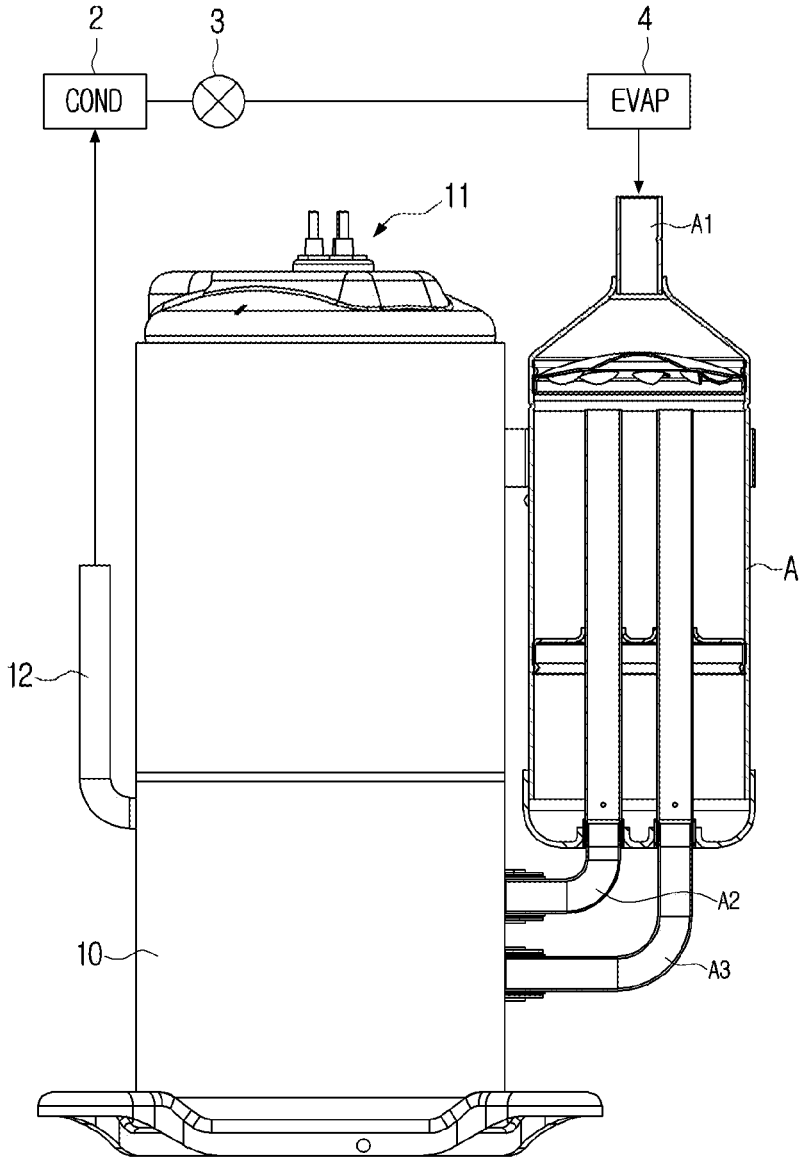
FIG. 2 RELATED ART
FIG. 2 is a schematic diagram of a rotary compressor of the related art in which an accumulator is disposed outside.
Figure 3:
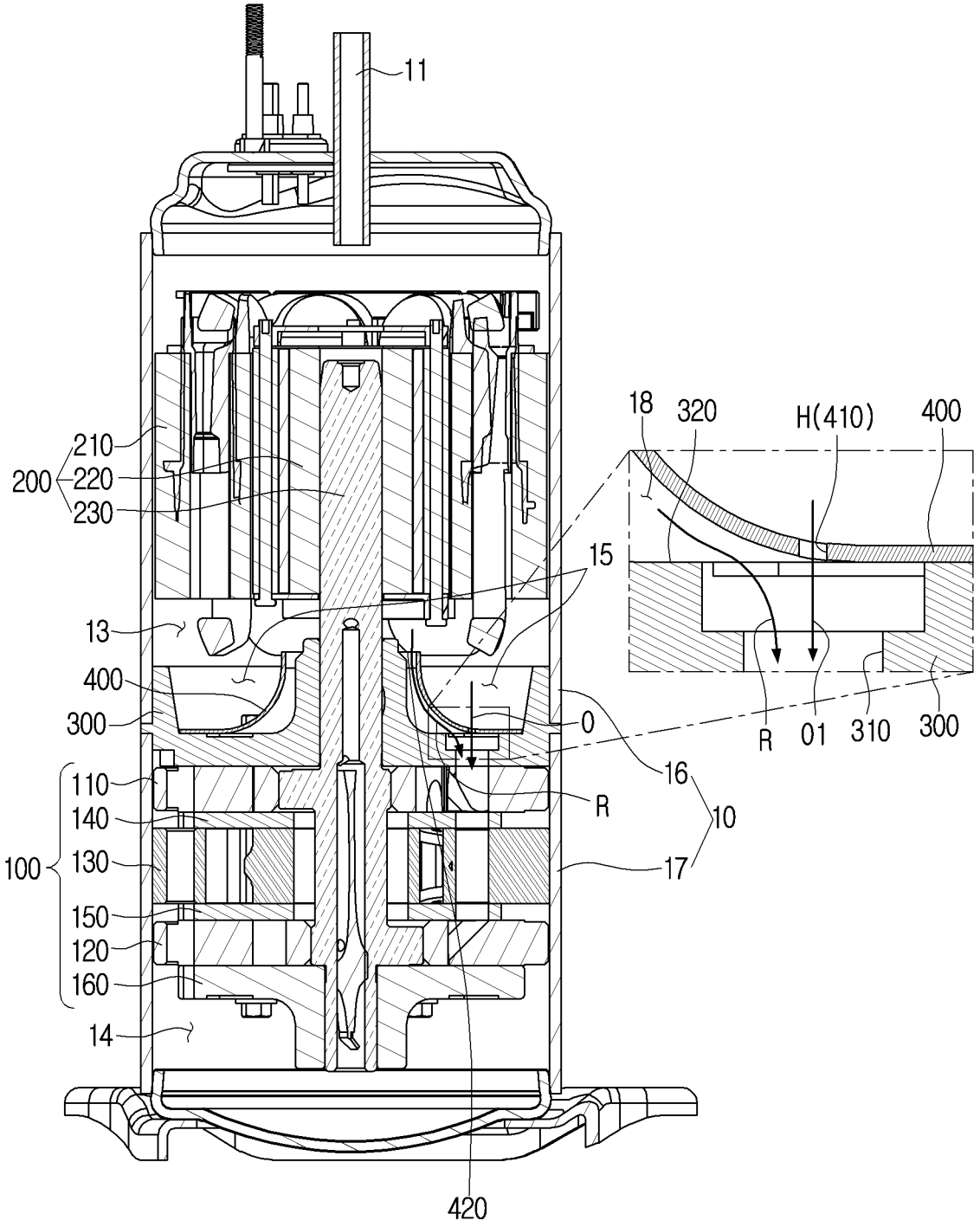
FIG. 3 is a cross-sectional view of a rotary compressor according to an embodiment.
Figure 4:
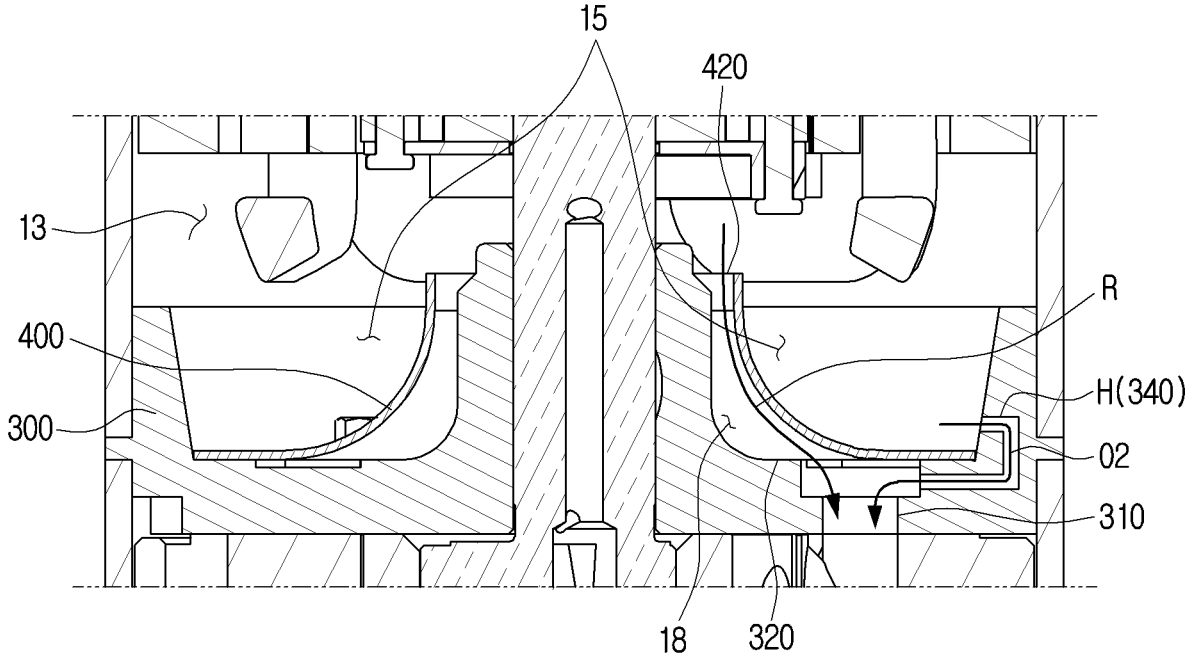
FIGS. 4 and 5 are diagrams illustrating various locations of a third hole according to an embodiment.
Figure 5:
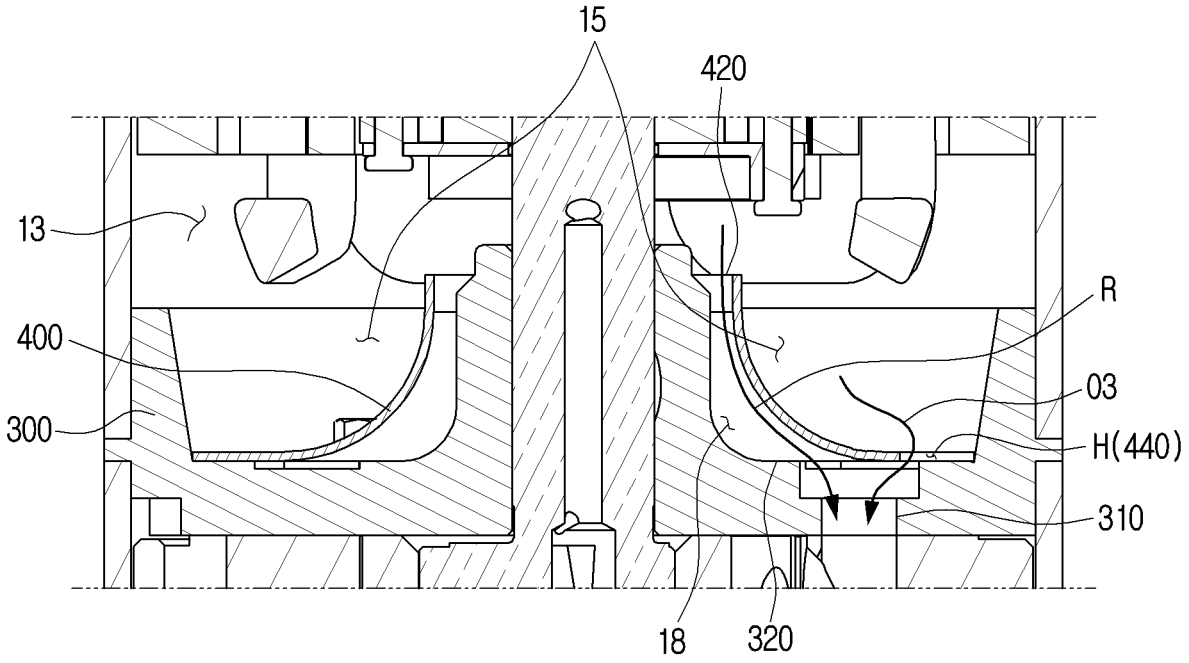

FIG. 1 is a schematic diagram showing a refrigerant cycle provided in a home appliance according to an embodiment. FIG. 2 is a schematic diagram of a rotary compressor of the related art in which an accumulator is disposed outside. FIG. 3 is a cross-sectional view of a rotary compressor according to an embodiment. FIGS. 4 and 5 are diagrams illustrating various locations of a third hole according to an embodiment.

Referring to FIG. 1, a refrigerant cycle has four processes of compression, condensation, expansion, and evaporation. The four processes of compression, condensation, expansion, and evaporation may occur when the refrigerant circulates through a rotary compressor 1, a condenser 2, an expansion valve 3, and an evaporator 4.

The rotary compressor 1 may compress the refrigerant gas in a state of a high temperature and a high pressure and discharge the refrigerant gas, and the refrigerant gas discharged from the rotary compressor 1 may flow to the condenser 2.

The condenser 2 may condense the refrigerant compressed in the compressor 1 and emit heat to the surrounding through the condensation process.

The expansion valve 3 may expand the refrigerant at the high temperature and high pressure condensed in the condenser 2 in a high pressure state, and the evaporator 4 may evaporate the refrigerator expanded in the expansion valve 3 and perform the evaporation while achieving a refrigeration effect by thermal exchange with an object to be frozen (or cooled) by using an evaporation latent heat to return the refrigerant gas at low temperature and low pressure to the rotary compressor 1. An air temperature of an indoor space may be adjusted through such a cycle.

In addition, a home appliance provided with such a refrigeration cycle may be any one of an air conditioner, a refrigerator, and a freezer. However, there is no limitation thereto and various home appliances provided with the refrigeration cycle may be used. The rotary compressor 1 according to an embodiment of the disclosure may be used in various devices including a compressor, in addition to the above home appliances.

Referring to FIG. 2, in a case of the rotary compressor of the related art, an accumulator A may be provided outside of a case 10. The accumulator A may receive a refrigerant at low temperature and low pressure from the evaporator 4 through an inlet A1 and transfer the refrigerant gas at low temperature and low pressure to the inside of the case 10 through at least one of outlets A2 and A3. A number of the outlets A2 and A3 of the accumulator A may be the same as a number of cylinders inside of the rotary compressor.

The accumulator A may temporarily accommodate a refrigerant, among the refrigerant at low temperature and low pressure received from the evaporator 4, which is not converted into gas and remains in a liquid phase, thereby preventing flow of the liquid-phase refrigerator into the compressor. In other words, only the liquid-phase refrigerant may remain inside of the accumulator A and the refrigerant in a gas state may flow into the compressor.

However, in a case of the rotary compressor 1 according to an embodiment of the disclosure, as will be described below in detail with reference to FIG. 3, the configuration of the accumulator disposed outside of the case 10 may be removed, and a first space 15 formed by a muffler member 400 disposed inside of the case 10 may perform the role of the accumulator. Accordingly, the entire volume of the rotary compressor 1 may be reduced to have a compact appearance.

The rotary compressor 1 may include the case 10, a compression device 100, a driving device 200, a flange member 300, and the muffler member 400.

The case 10 may form an appearance of the rotary compressor 1. The case 10 may include an inlet 11 which is connected to the evaporator 4 to introduce the refrigerant from the evaporator 4, and an outlet 12 which is connected to the condenser 2 and through which the refrigerator compressed at high temperature and high pressure in the rotary compressor 1 is discharged.

The compression device 100 may have a compression space in which the refrigerant introduced to the inlet is accommodated, and compress the refrigerant in the compression space to discharge the refrigerant to the outlet.

The compression device 100 may include a first cylinder 110, a second cylinder 120, a middle plate 130, a first discharge plate 140, a second discharge plate 150, and an additional flange member 160. In other words, the compression device 100 may have a twin cylinder structure.

However, the structure of the compression device 100 is not limited thereto and a single cylinder structure may be used. The structure of the compression device 100 will be described with reference to FIGS. 4 to 6.

The driving device 200 may drive the compression device. The driving device may include a stator 210 which is fixed to an inner surface of the case 10, a rotor 220 which is rotatably installed inside of the stator 210, and a rotating shaft 230 which is provided to rotate along with the rotor 220 inside of the rotor 220.

The rotating shaft 230 may be connected to the compression device 100 to cause rolling pistons 111 and 121 (FIG. 8) of the compression device 100 to orbit, thereby compressing the refrigerant introduced to the compression device 100.

Accordingly, the driving device 200 may be connected to the compression device 100 through the rotating shaft 230 to transfer power to the compression device 100.

The flange member 300 may partition the inside of the case 10 into a low-pressure region 13 and a high-pressure region 14. The low-pressure region 13 may communicate with the inlet 11 and the driving device 200 may be disposed therein. The high-pressure region 14 may communicate with the outlet 12 and the compression device 100 may be disposed therein.

In other words, the inside of the case 10 may be partitioned by the flange member 300 into the low-pressure region 13 in which the refrigerator at low temperature and low pressure is disposed and the high-pressure region 14 in which the refrigerant at high temperature and low pressure is disposed.

Since the driving device 200 is disposed in the low-pressure region 13, the driving device may be refrigerated continuously by the refrigerant at low temperature and low pressure, thereby enhancing the efficiency and enlarging a driving region.

The flange member 300 may include a first hole 310 which causes the low-pressure region 13 to communicate with the compression space of the compression device 100. Accordingly, oil and refrigerant located in the low-pressure region 13 may move towards the high-pressure region 14 along the first hole 310.

The oil may perform a lubricating action between the rotating configuration and non-rotating configuration of the compression device 100.

The muffler member 400 may cover one surface 320 of the flange member 300 facing the low-pressure region 13 to form the first space 15 for storing the oil on an outer side. In addition, the muffler member 400 may form a second space 18 which communicates with the first hole 310 on an inner side thereof.

The first space 15 may be formed in a substantially torus shape between an outer surface of the muffler member 400 and a side wall of the flange member 300. The second space 18 may be formed between an inner surface of the muffler member 400 and the one surface 320 of the flange member 300.

The muffler member 400 may include a second hole 420 which forms a refrigerant flow path R from the low-pressure region 13 to the second space 18.

At least one of the flange member 300 and the muffler member 400 may include a third hole H which forms an oil flow path O from the first space 15 to the first hole 310.

For example, referring to FIG. 3, the muffler member 400 may include a third hole 410 which penetrates the muffler member 400 in a thickness direction so that the outer side of the muffler member 400 communicates with the inner side. In other words, the third hole 410 of the muffler member 400 may form an oil flow path O1 which penetrates the muffler member 400. Accordingly, the oil stored in the first space 15 may move to the first hole 310 through the third hole 410 formed in the muffler member 400.

In addition, referring to FIG. 4, the third hole H may also be formed in the flange member 300. In other words, the flange member 300 may include a third hole 340 which causes the first space 15 to communicate with the first hole 310. For example, the flange member 300 may include a side wall surrounding the first space 15, and the third hole 340 may be formed at the side wall of the flange member 300 to be extended to the first hole 310. Accordingly, the third hole 340 of the flange member 300 may form an oil flow path O2 through which the oil stored in the first space 15 goes around the muffler member 400.

In addition, referring to FIG. 5, the third hole H may be implemented as an opening region 440 obtained by cutting a part of the muffler member 400. For example, the opening region 440 may be formed in one region of an edge of the muffler member 400 corresponding to the first hole 310. In other words, the opening region 440 may form an oil flow path O3 which penetrates through the muffler member 400 through the opening region 440.

FIGS. 3 to 5 illustrate that the third hole H is formed in at least one of the flange member 300 and the muffler member 400, but there is no limitation thereto, and the third hole H may be formed in both the flange member 300 and the muffler member 400.

In other words, the oil may be stored in the first space 15 and some may move to the first hole 310 through the third hole H. In addition, the refrigerant in the liquid state among the refrigerant discharged from the evaporator 4 may be stored in the first space 15 and only the refrigerant in the gas state may move to the compression device 100 through the second hole 420.

Meanwhile, not only the oil, but the refrigerant in the liquid state may also move through the third hole H. However, the refrigerants in the oil and liquid state may be separated as layers due to a difference in density and do not move to the compression device 100 at the same time through the third hole H, thereby preventing breakdown of the compression device 100 and the driving device 200.

Meanwhile, the refrigerant in the gas state flowing to the inside of the case 10 through the inlet 11 may move from the outer side of the muffler member 400 to the second space 18 of the inside of the muffler member 400 through the second hole 420. Hereinafter, the refrigerant may move to the compression space of the compression device 100 through the first hole 310 of the flange member 300.

In other words, the configuration of the accumulator disposed at the outside of the case 10 in the related art may be removed, and the first space 15 formed by the muffler member 400 disposed in the case 10 may perform the role of the accumulator. Accordingly, a total volume of the rotary compressor 1 may be removed (or reduced) to have a compact appearance.

The muffler member 400 may be formed to be curved so as to be gradually distanced from the one surface 320 of the flange member 300, as it goes from the edge to the center.

Accordingly, since the first space 15 formed between the center portion of the muffler member 400 and the inner side of the case 10 has a sufficient volume, a sufficiently large amount of refrigerant in the oil and liquid states may be stored in the first space 15.

It is illustrated that the first space 15 is formed between the center portion of the muffler member 400 and the side wall formed to protrude along the edge of the flange member 300, but there is no limitation thereto, and the first space may be formed between the center portion of the muffler member 400 and the inner side of the case 10.

The second hole 420 of the muffler member 400 may be formed at the center of the muffler member 400 and the rotating shaft 230 may penetrate therethrough. In addition, an inner diameter of the second hole 420 may be formed to be larger than an outer diameter of the rotating shaft 230, and the refrigerant in the gas state may move to a gap between the second hole 420 and the rotating shaft 230. The second hole 420 may be formed on an upper side of (or above) the third hole H.

The third hole 410 of the muffler member 400 may be formed so as to face the first hole 310 of the flange member 300. For example, the first and second holes 310 and 410 may be disposed to overlap each other, when the low-pressure region 13 is seen from the high-pressure region 14.

Accordingly, the oil passed through the third hole 410 from the first space 15 may easily move to the high-pressure region 14 side, without bumping into the flange member 300 or being obstructed by it.

It is illustrated that one third hole 410 is formed on the muffler member 400 but the number thereof is not limited thereto. In other words, the third hole 410 may be formed as a plurality of third holes 410 along a circumference direction of the muffler member 400. The plurality of third holes 410 may be spaced from each other in the circumferential direction at equal intervals or irregular intervals. According to the required amount of the oil of the compression device 100, the third hole 410 may be formed at various heights and locations of the muffler member 400. As shown in FIG. 3, the third hole 410 may be formed on a curved section of the muffler member 400 which is spaced apart from the one surface 320 of the flange member 300.

The case 10 may include a first case 16 in which the inlet 11 is disposed and which forms the low-pressure region 13 and a second case 17 in which the outlet 12 is disposed and which forms the high-pressure region 14.

Edges of the first and second cases 16 and 17 may be connected by welding or the like so as to form an inner space of the case 10. Meanwhile, the driving device 200 disposed in the low-pressure region 13 may be continuously cooled by the refrigerant, thereby enhancing the efficiency. Accordingly, the same efficiency may be exhibited although the diameter of the driving device 200 is reduced.

Accordingly, the second case 17 may have an inner diameter larger than that of the first case 16, and the cylinder of the compression device 100 disposed in the second case 17 may have an increased height than the diameter, thereby increasing displacement. In other words, the efficiency of the compression device 100 may be increased while not reducing the efficiency of the driving device 200.

Figure 6:
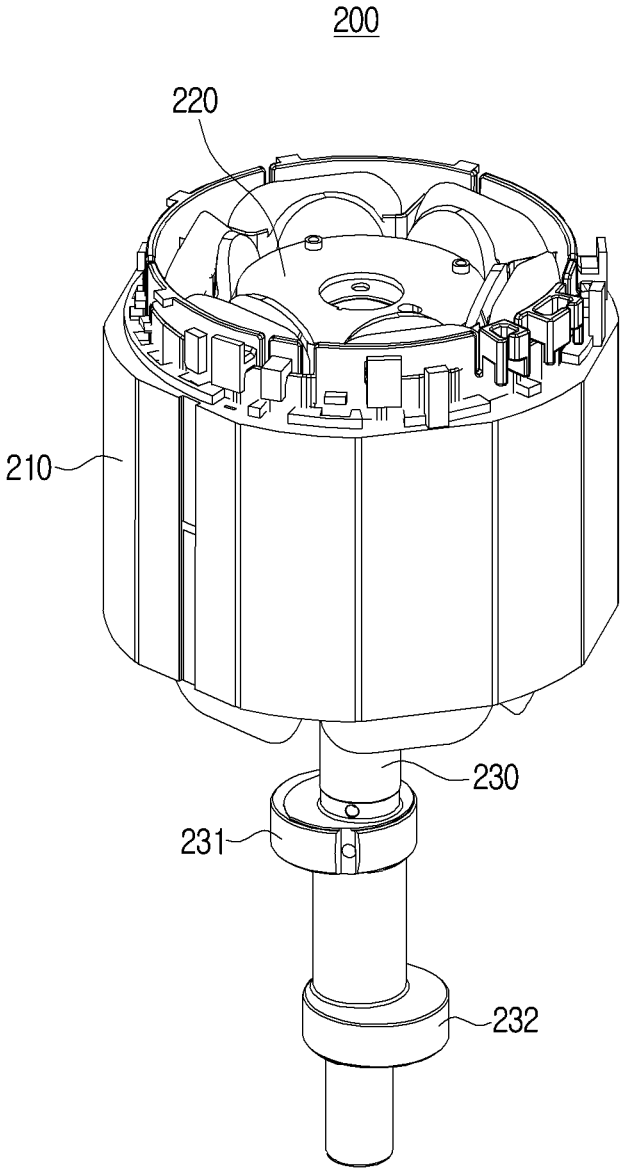
FIG. 6 is a perspective view of a driving device according to an embodiment.
Figure 7:
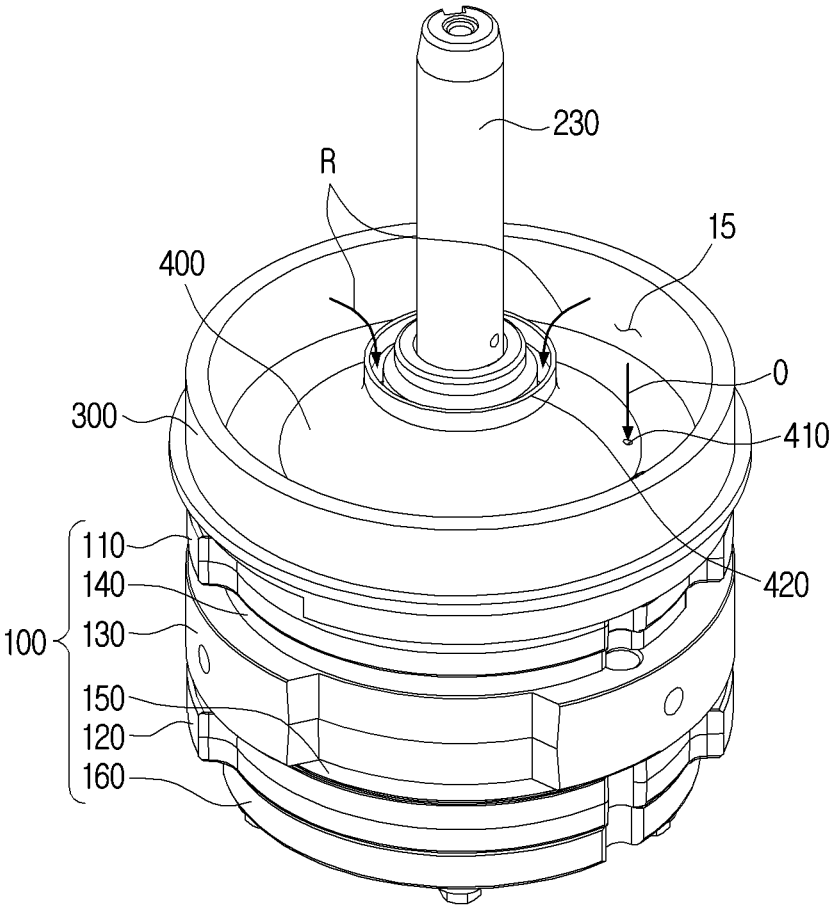
FIG. 7 is a perspective view of a compression device according to an embodiment.
Figure 8:
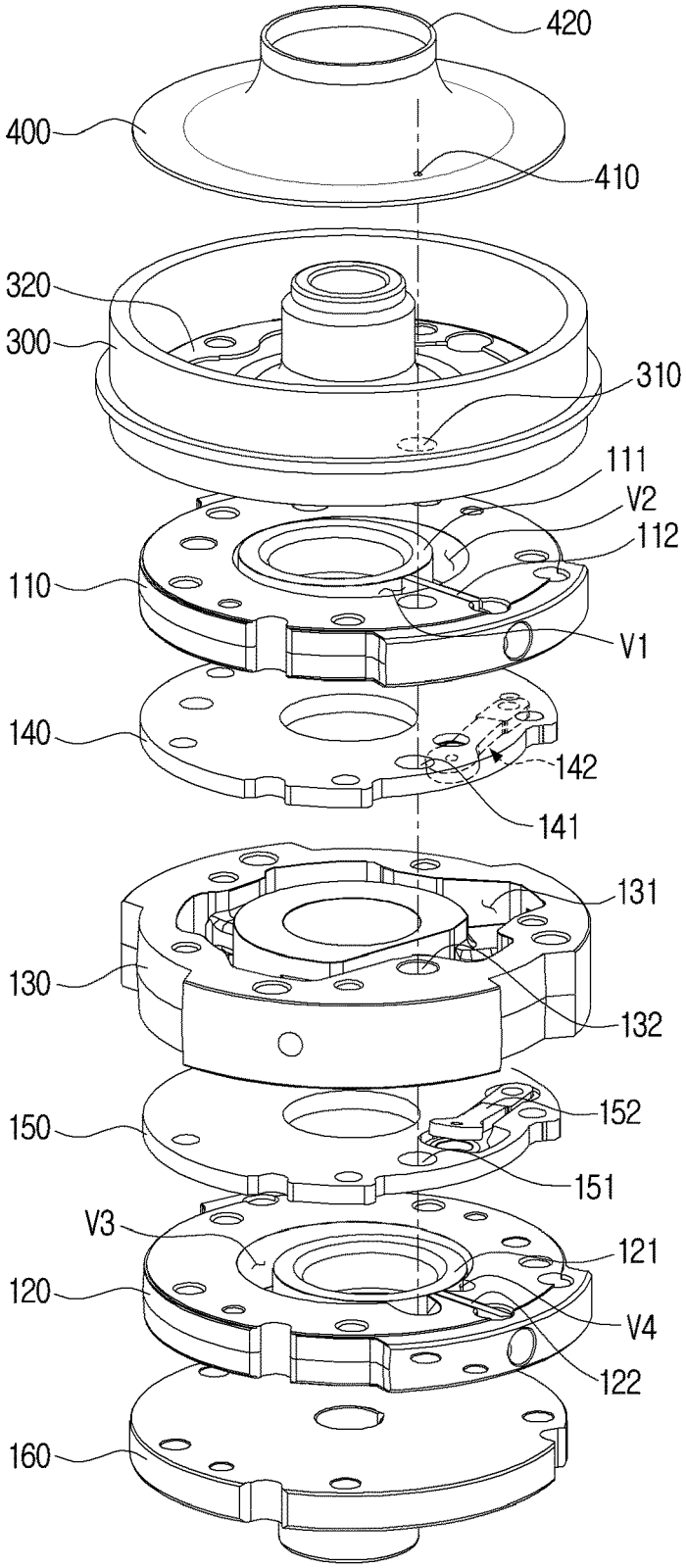
FIG. 8 is an exploded perspective view of the compression device of FIG. 7.

FIG. 6 is a perspective view of the driving device according to an embodiment. FIG. 7 is a perspective view of the compression device according to an embodiment. FIG. 8 is an exploded perspective view of the compression device of FIG. 7.

Referring to FIGS. 6 to 8, the compression device 100 may include a first cylinder 110, a second cylinder 120, and a middle plate 130.

The first cylinder 110 may include a rolling piston 111 which turns with eccentricity in the compression space, and a vane 112 which comes into contact with the rolling piston 111 to partition the compression space into a suction chamber V1 and a compression chamber V2.

The second cylinder 120 may include a rolling piston 121 which turns with eccentricity in the compression space, and a vane 122 which comes into contact with the rolling piston 121 to partition the compression space into a suction chamber V3 and a compression chamber V4.

For example, the rolling pistons 111 and 121 may be formed in a cylindrical shape and eccentric portions 231 and 232 of the driving device 200 combined with the rotating shaft 230 may be disposed therein. As the rotating shaft 230 rotates, the eccentric portions 231 and 232 move, and accordingly, the rolling pistons 111 and 121 may turn. Each of the rolling pistons 111 and 121 of the first and second cylinders 110 and 120 may eccentrically rotate to have a phase difference at 180 degrees in the circumferential or rotational direction of the rotating shaft 230.

The middle plate 130 may be disposed between the first and second cylinders 110 and 120 and a discharge space 131 may be provided therein. The compressed refrigerant may be discharged to the discharge space 131 from the first and second cylinders 110 and 120, and the discharge space may communicate with the outlet 12.

In other words, refrigerant at low temperature and low pressure which has moved to the compression device 100 by sequentially passing through the second hole 420 of the muffler member 400 and the first hole 310 of the flange member 300 from the low-pressure region 13, may be compressed into the refrigerant at high temperature and high pressure in the compression space of the compression device 100 and move to the discharge space 131 of the middle plate 130. Then, the refrigerant at high temperature and high pressure may move to the condenser 2 through the outlet 12 from the discharge space 131.

In other words, the above movement path of the compressed refrigerant is completely separated from the low-pressure region 13, and accordingly, a differential pressure between the low-pressure region 13 and the high-pressure region 14 may be maintained.

The middle plate 130 may include a fourth hole 132 which causes the suction chamber V1 of the first cylinder 110 to communicate with the suction chamber V3 of the second cylinder 120.

In other words, a part of the refrigerant at low temperature and low pressure before compression may move to the suction chamber V1 of the first cylinder 110 through the first hole 310 of the flange member 300, and another part thereof may move to the suction chamber V3 of the second cylinder 120 through the fourth hole 132. Accordingly, the refrigerant may be efficiently compressed in each of two compression spaces of the first and second cylinders 110 and 120.

The compression device 100 may include a first discharge plate 140 disposed between the first cylinder 110 and the middle plate 130, and a second discharge plate 150 disposed between the second cylinder 120 and the middle plate 130.

The first discharge plate 140 may include a fifth hole 141 for causing the suction chamber V1 of the first cylinder 110 to communicate with the fourth hole 132, and a first valve device 142 for causing the compression chamber V2 of the first cylinder 110 to selectively communicate with the discharge space 131.

The first valve device 142 may be disposed at one surface of the first discharge plate 140 facing the middle plate 130 and rotate in the discharge space 131 of the middle plate 130 to cause the compression chamber V2 of the first cylinder 110 to selectively communicate with the discharge space 131.

The second discharge plate 150 may include a sixth hole 151 for causing the suction chamber V3 of the second cylinder 120 to communicate with the fourth hole 132, and a second valve device 152 for causing the compression chamber V4 of the second cylinder 120 to selectively communicate with the discharge space 131.

The second valve device 152 may be disposed at one surface of the second discharge plate 150 facing the middle plate 130 and rotate in the discharge space 131 of the middle plate 130 to cause the compression chamber V4 of the second cylinder 120 to selectively communicate with the discharge space 131.

In other words, only in a case of exceeding a predetermined pressure, the first and second valve devices 142 and 152 may cause each of the compression chambers V2 and V4 of the first and second cylinders 110 and 120 to communicate with the discharge space 131 of the middle plate 130. Accordingly, only the refrigerant sufficiently compressed at high pressure may move to the discharge space 131 of the middle plate 130.

In addition, a part of the refrigerant at low temperature and low pressure before compression may move to the suction chamber V1 of the first cylinder 110 through the first hole 310 of the flange member 300, and another part thereof may move to the suction chamber V3 of the second cylinder 120 by sequentially passing through the fifth hole 141, the fourth hole 132, and the sixth hole 151. Accordingly, the refrigerant may be efficiently compressed in each of two compression spaces of the first and second cylinders 110 and 120.

Figure 9:
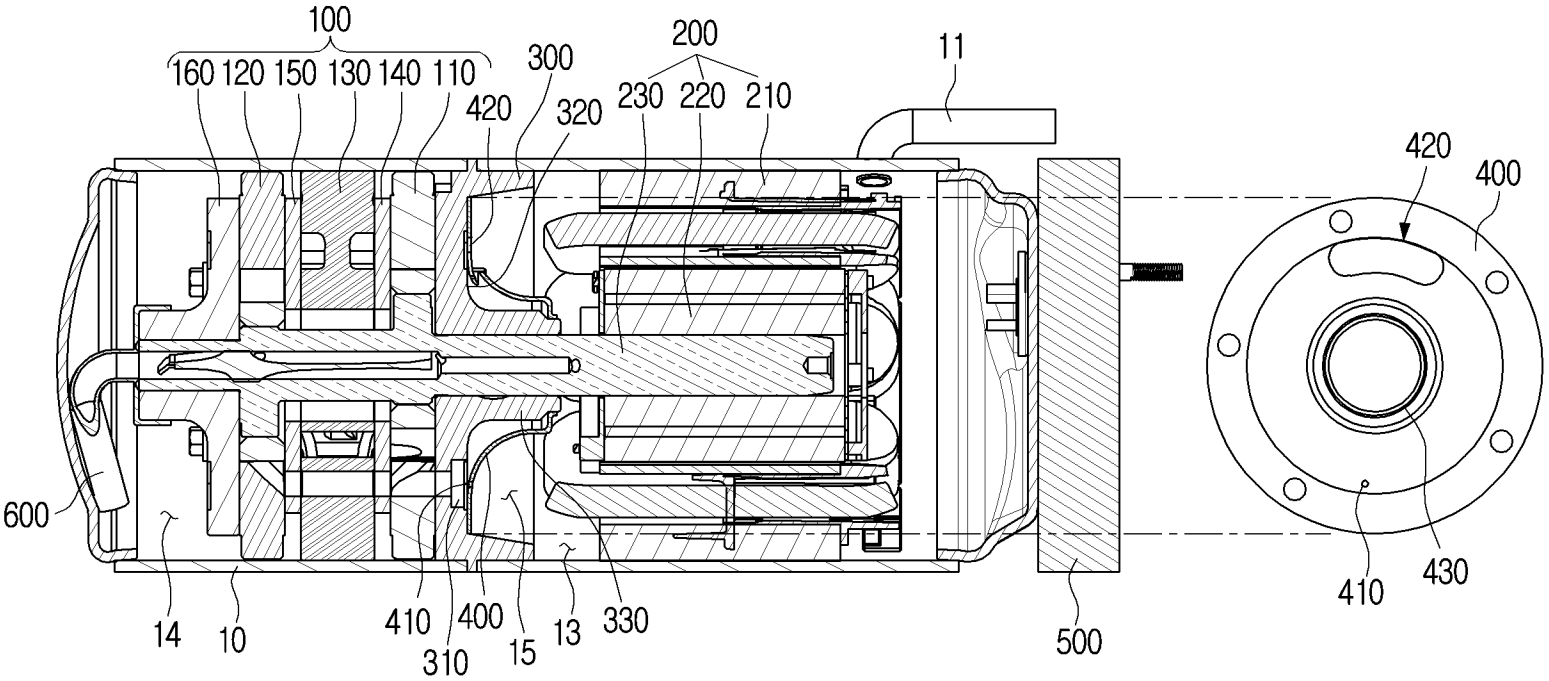
FIG. 9 is a cross-sectional view of a horizontal type rotary compressor according to an embodiment.
Figure 10:
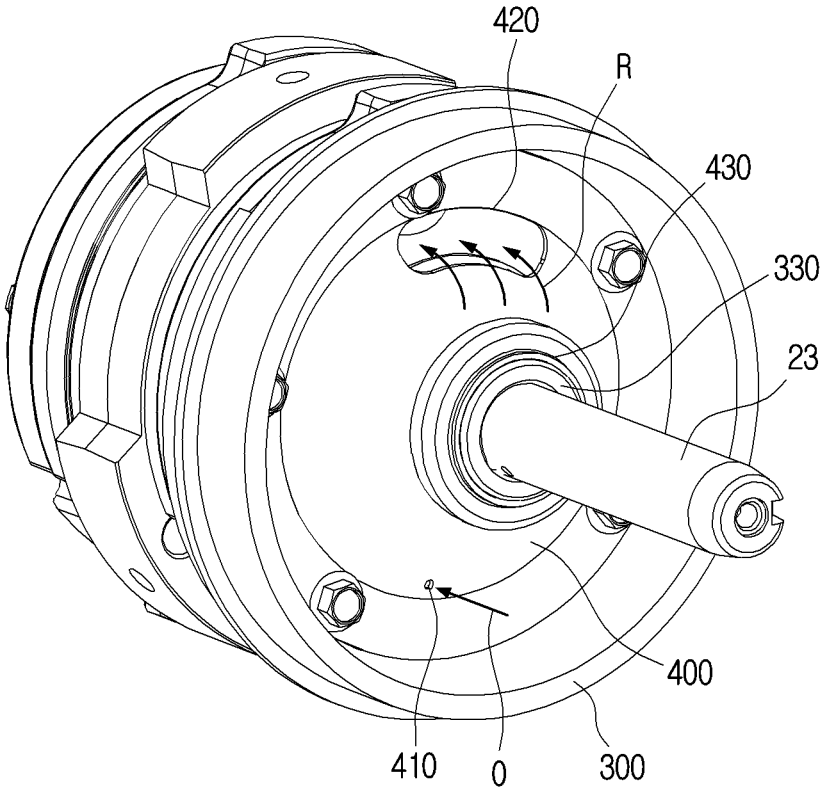
FIG. 10 is a perspective view of a compression device of the horizontal type rotary compressor of FIG. 9.
Figure 11:
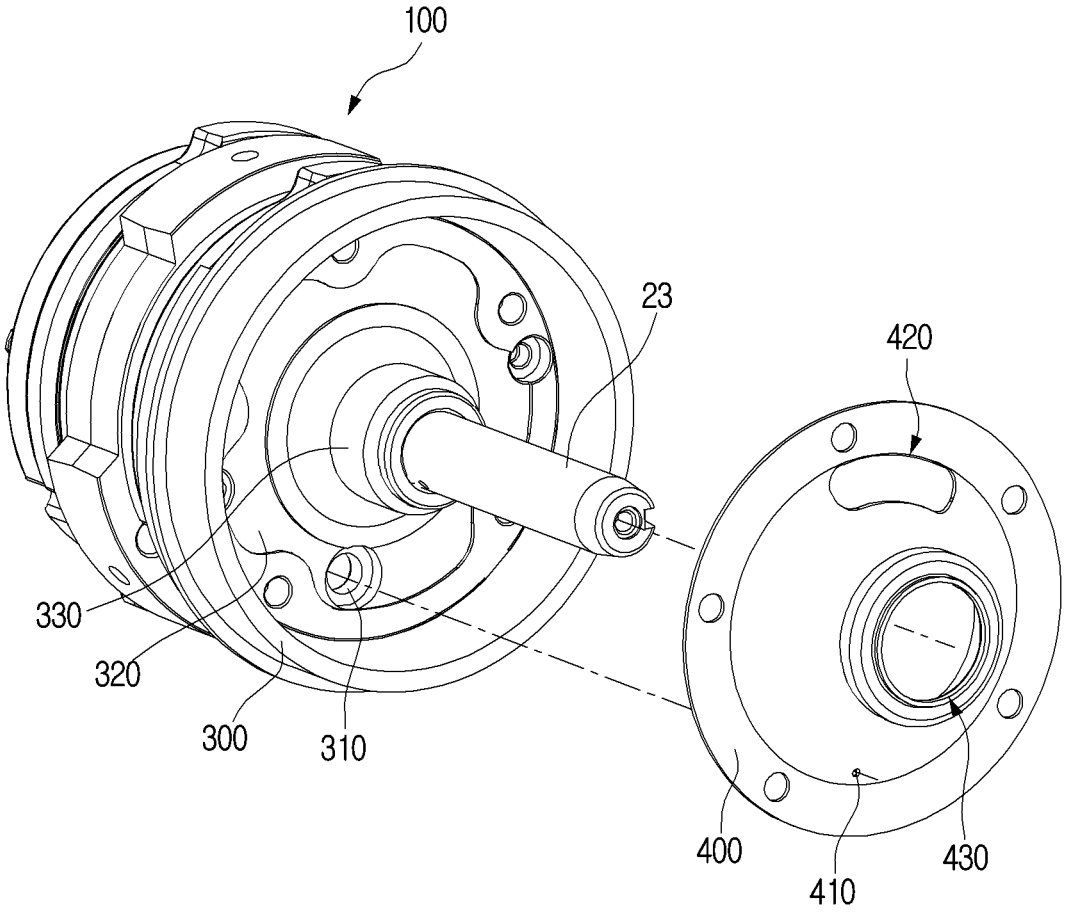
FIG. 11 is an exploded perspective view of the compression device of FIG. 10.

FIG. 9 is a cross-sectional view of a horizontal type rotary compressor according to an embodiment. FIG. 10 is a perspective view of a compression device of the horizontal type rotary compressor of FIG. 9. FIG. 11 is an exploded perspective view of the compression device of FIG. 10.

Referring to FIGS. 9 to 11, the driving device 200 may include the rotating shaft 230 which is disposed horizontally and connected to the compression device 100. In other words, the rotary compressor 1 of FIGS. 9 to 11 may be a horizontal type rotary compressor. The rotary compressor 1 of FIGS. 9 to 11 may have a substantially similar structure as the vertical type rotary compressor described above, and the same reference numerals are used for the same configuration as the configuration described above, and therefore the overlapped description will not be repeated.

At least one of the flange member 300 and the muffler member 400 may include the third hole which forms the oil flow path O from the first space 15 to the first hole 310. FIG. 9 illustrates that the third hole 410 is formed in the muffler member 400, but the location of the third hole is not limited thereto and may be implemented with various structures, as illustrated in FIG. 4 or 5.

The muffler member 400 may include a center hole 430 disposed on a lower side of the second hole 420. In other words, the rotating shaft 230 may penetrate the center hole 430 of the muffler member 400, and the refrigerant may move from the low-pressure region 13 to the high-pressure region 14 through the second hole 420 disposed on an upper side of the center hole 430.

The flange member 300 may include a center region 330 having an inner surface which rotatably supports the rotating shaft 230 and an outer surface which is fit to the center hole 430. The center region 330 may be formed to protrude to be separated from one surface of the flange member 300 compared to the edge region.

Since the outer surface of the center region 330 is fit to the center hole 430 without a gap, the refrigerant may not move between the flange member 300 and the center hole 430 of the muffler member 400, and may move to the inside of the muffler member 400 through the second hole 420 located at the upper side of the center hole 430.

Accordingly, since the second hole 420 is formed to be sufficiently high, the oil stored in the first space 15 may be prevented from moving to the compression device 100 through the second hole 420 or the center hole 430 unintentionally. For example, as shown in FIG. 9, the second hole 420 may be disposed above a center of center hole 430 and above the rotating shaft 230.

According to the eccentric rotation of the rolling piston, the volume of the suction chamber of the cylinder repeatedly increases and decreases, and accordingly, the inner pressure of the suction chamber may also repeatedly increase and decrease according to Boyle's law. In other words, according to the change of the inner pressure of the suction chamber described above, the oil may move to the suction chamber of the cylinder in the first space 15 through the third hole 410 and the first hole 310 which communicates with the suction chamber of the cylinder.

The third hole 410 may be disposed to be adjacent to a lower surface of the case 10, and accordingly, the oil may not be excessively accumulated in the first space 15 and may move more easily to the high-pressure region 14 from the low-pressure region 13.

The rotary compressor 1 may further include an oil supply pipe 600 having one end communicating with the inner portion of the rotating shaft 230 and another end sinking in the oil stored in the high-pressure region 14. The oil supply pipe 600 may form an oil flow path moving into the rotating shaft 230 from the high-pressure region 14 due to a differential pressure of the high-pressure region 14 and the low-pressure region 13.

The rotary compressor 1 may further include an inverter 500 which supplies a driving current to the driving device 200. The inverter 500 may supply a driving current to the driving device 200 based on a control signal of the control device. The inverter 500 may supply the driving current to the driving device 200 according to the conversion from a direct current to an alternating current, thereby enhancing electricity.

Meanwhile, the inverter 500 may be a configuration for which continuous cooling is necessary, and therefore the inverter may be disposed at a part of the outer surface of the case 10 corresponding to the low-pressure region 13. Accordingly, without a separate cooling system or space, the inverter 500 may be stably driven since it is attached to the low-temperature case 10, and the rotary compressor 1 may have a compact appearance.

While example embodiments of the disclosure have been shown and described, the disclosure is not limited to the aforementioned example embodiments, and it is apparent that various modifications can be made by those having ordinary skill in the technical field to which the disclosure belongs, without departing from the scope of the disclosure as claimed by the appended claims. Also, it is intended that such modifications are not to be interpreted independently from the technical idea or scope of the disclosure.

What is claimed is:

1. A rotary compressor, comprising:

a case including an inlet and an outlet;

a compression device including a compression space to accommodate a refrigerant introduced through the inlet, and to compress the refrigerant in the compression space and discharge the refrigerant to the outlet;

a driving device configured to drive the compression device;

a flange member configured to partition an inner portion of the case into a low-pressure region which communicates with the inlet and in which the driving device is disposed, and a high-pressure region which communicates with the outlet and in which the compression device is disposed; and a muffler member disposed on a surface of the flange member facing the low-pressure region to form, on an outer side of the muffler member, a first space to store oil, and to form, on an inner side of the muffler member, a second space, wherein the flange member includes a first hole communicating with the second space to allow the low-pressure region to communicate with the compression space, the muffler member includes a second hole which forms a refrigerant flow path from the low-pressure region to the second space, and at least one of the flange member and the muffler member includes a third hole which forms an oil flow path from the first space to the first hole.

2. The rotary compressor according to claim 1, wherein the muffler member is curved such that a distance between the surface of the flange member and the muffler member increases from an edge of the muffler member to a center of the muffler member.

3. The rotary compressor according to claim 2, wherein the driving device includes a rotating shaft which penetrates through the second hole, the rotating shaft is connected to the compression device, and the second hole is formed at the center of the muffler member.

4. The rotary compressor according to claim 1, wherein the third hole is formed in the muffler member to face the first hole.

5. The rotary compressor according to claim 1, wherein the third hole is formed as a plurality of holes along a circumferential direction of the muffler member.

6. The rotary compressor according to claim 1, wherein the compression device includes:

a first cylinder including a first rolling piston which turns with eccentricity in the compression space, and a first vane to come into contact with the first rolling piston to partition the compression space into a first suction chamber and a first compression chamber, a second cylinder including a second rolling piston which turns with eccentricity in the compression space, and a second vane to come into contact with the second rolling piston to partition the compression space into a second suction chamber and a second compression chamber, and a middle plate disposed between the first and second cylinders and including a discharge space to which the compressed refrigerant is discharged from the first and second cylinders and which communicates with the outlet.

7. The rotary compressor according to claim 6, wherein the middle plate includes a fourth hole to allow the first suction chamber of the first cylinder to communicate with the second suction chamber of the second cylinder.

8. The rotary compressor according to claim 7, wherein the compression device includes:

a first discharge plate disposed between the first cylinder and the middle plate and including a fifth hole to allow the first suction chamber of the first cylinder to communicate with the fourth hole, and a first valve device to allow the first compression chamber of the first cylinder to selectively communicate with the discharge space, and a second discharge plate disposed between the second cylinder and the middle plate and including a sixth hole to allow the second suction chamber of the second cylinder to communicate with the fourth hole, and a second valve device to allow the second compression chamber of the second cylinder to selectively communicate with the discharge space.

9. The rotary compressor according to claim 1, wherein the case includes:

a first case in which the inlet is disposed and which forms the low-pressure region, and a second case in which the outlet is disposed and which forms the high-pressure region, the second case having an inner diameter larger than an inner diameter of the first case.

10. The rotary compressor according to claim 1, further comprising:

an inverter, disposed at a part of an outer surface of the case corresponding to the low-pressure region, and configured to supply a driving current to the driving device.

11. The rotary compressor according to claim 1, wherein the driving device includes a rotating shaft horizontally disposed and connected to the compression device, and the muffler member includes a center hole disposed below the second hole.

12. The rotary compressor according to claim 11, wherein the flange member includes a center region having an inner surface which rotatably supports the rotating shaft and an outer surface which is fit to the center hole.

13. The rotary compressor according to claim 11, further comprising:

an oil supply pipe including one end communicating with an inner portion of the rotating shaft and another end sinking in oil stored in the high-pressure region, and the oil supply pipe forms an oil flow path moving into the rotating shaft from the high-pressure region due to a differential pressure of the high-pressure region and the low-pressure region.

14. A home appliance, comprising:

a rotary compressor configured to compress a refrigerant, the rotary compressor including:

a case including an inlet and an outlet, a compression device including a compression space to accommodate the refrigerant introduced through the inlet, and configured to compress the refrigerant in the compression space and to discharge the refrigerant to the outlet, a driving device configured to drive the compression device;

a flange member configured to partition an inner portion of the case into a low-pressure region which communicates with the inlet and in which the driving device is disposed, and a high-pressure region which communicates with the outlet and in which the compression device is disposed, and a muffler member disposed on a surface of the flange member facing the low-pressure region to form, on an outer side of the muffler member, a first space to store oil, and to form, on an inner side of the muffler member, a second space, and wherein the flange member includes a first hole communicating with the second space to allow the low-pressure region to communicate with the compression space, the muffler member includes a second hole which forms a refrigerant flow path from the low-pressure region to the second space, and at least one of the flange member and the muffler member includes a third hole which forms an oil flow path from the first space to the first hole.

15. The home appliance according to claim 14, wherein the home appliance is any one of an air conditioner, a refrigerator, and a freezer.

* * * * *